United States Patent [19]

Metcalfe

[11] Patent Number: 5,042,281

[45] Date of Patent: Aug. 27, 1991

[54] ISOTHERMAL SHEET ROLLING MILL

[76] Inventor: Arthur G. Metcalfe, 2108 E. 24th St., National City, Calif. 92050

[21] Appl. No.: 582,242

[22] Filed: Sep. 14, 1990

[51] Int. Cl.[5] ..... B21J 5/08

[52] U.S. Cl. ..... 72/200; 219/81

[58] Field of Search ..... 72/200, 243.6, 241.2, 72/242.1, 242.7, 242.8; 219/81, 83, 152

[56] References Cited

U.S. PATENT DOCUMENTS

| | | | |
|---|---|---|---|
| 3,644,698 | 2/1972 | Metcalfe et al. | 219/83 |
| 3,823,299 | 7/1974 | Metcalfe et al. | 219/83 |
| 3,851,138 | 11/1974 | Metcalfe et al. | 219/83 |
| 3,944,782 | 3/1976 | Metcalfe et al. | 219/152 |
| 3,988,913 | 11/1976 | Metcalfe et al. | 72/69 |
| 3,988,914 | 11/1976 | Metcalfe et al. | 72/69 |
| 4,150,279 | 4/1979 | Metcalfe et al. | 219/152 |

FOREIGN PATENT DOCUMENTS

| | | | |
|---|---|---|---|
| 0180311 | 7/1988 | Japan | 72/200 |

*Primary Examiner*—Lowell A. Larson
*Assistant Examiner*—M. J. McKeon
*Attorney, Agent, or Firm*—Brown, Martin, Haller & McClain

[57] ABSTRACT

A method and apparatus for the solid-state forming of a metallic feedstock into thin sheet or foil is disclosed that uses improved isothermal roll forging techniques. The improvements include the use of rotatable backup rolls for increasing hollow work roll stiffness, two independent work roll heating controllers, a reduced work roll diameter and other means for precise control of conditions within a feedstock "travelling hot zone" (THZ). The disclosed improvements allow the application of isothermal roll forging techniques to the rolling of thin sheets from difficult-to-work, high-strength metals such as aluminides, intermetallics, superalloys, titanium alloys, ODS composites, beryllium, and others in sheets having widths of 24-inches and more.

12 Claims, 7 Drawing Sheets

ISOTHERMAL SHEET ROLLING MILL

BACKGROUND OF THE INVENTION

1. Field of the Invention

The present invention involves generally the shaping of metals and, more particularly, involves an improved method for forming wide sheets and foils, especially from those metals that are difficult to process by conventional methods. The term "metal" as used herein includes elemental metals, metal alloys, oxide-dispersion strengthened alloys and intermetallic compounds unless otherwise specified.

2. Description of Related Art

Many methods are known in the art for the forming of metallic feedstock into selected shapes by solid-state deformation. These include rolling, forging, drawing or cupping, spinning, and extrusion. The usefulness of these techniques depends primarily on the feedstock metal properties such as ductility, brittleness, hardness and strain hardening.

Many metals cannot be shaped at room temperature because they are too brittle, strain harden excessively, or are too strong. Hot shaping of such a metal is often used but cooling of the metal surface by steel tools, dies, or rolls may cause cracking and thereby prevent formation of thin sections. One preferred method known in the art for forming relatively thin sheets of high-temperature metals such as titanium- and nickel-based alloys is the isothermal forming method disclosed by Metcalfe, et al. in U.S. Pat. No. 3,944,782. This method is an isothermal metal roll forging technique in which feedstock is heated and rolled under pressure by molybdenum alloy dies or rolls, which serve as conductive electrodes for passing current through the contact resistance at the roll-feedstock contact line. This contact line heating produces a "travelling hot zone" (THZ) in each molybdenum alloy roll in the work region where the work roll contacts the metal feedstock. The THZ moves along the work roll perimeter as the roll turns against the feedstock. The precision control of both temperature and pressure at the THZ in the work region causes the metal feedstock to become plastic and flow into the selected configuration. The electrical current through the work roll electrodes at the feedstock contact lines also forms a THZ in the metal feedstock within the work region where the desired plastic deformation of the feedstock metal occurs. The THZ in the feedstock differs markedly from the conditions present during conventional hot working where the feedstock is heated uniformly in a furnace before passage between unheated steel rolls that chill the feedstock surface at the work region. When I speak of the THZ in this patent, I am referring to the THZ within the feedstock work region.

The technical key to successful isothermal roll forging is the precise control of conditions within the THZ of the feedstock work region. Metals such as titanium alloys, beryllium, superalloys and titanium aluminides must be deformed in narrow ranges of temperature and pressure. Failure to control conditions precisely throughout the THZ will spoil the usefulness and value of the rolled metal product.

In U.S. Pat. Nos. 3,988,913 and 3,988,914 issued on Nov. 2, 1976, Metcalfe, et al., describe isothermal metal forming apparatus for implementing the technique disclosed in the earlier patent. In U.S. Pat. No. 4,150,279 issued on Apr. 17, 1979, Metcalfe, et al. disclose an apparatus adapted to form large metal rings using isothermal metal forming methods.

In these earlier patents, I disclosed several processes based on the isothermal metal roll forging technique. My basic concept was a method to shape feedstock between molybdenum alloy tools while precisely controlling feedstock temperature by passing an electric current through both the tools and the feedstock during the shaping process. Usually the molybdenum tools are rolls or portions of rolls used in a continuous process to perform diffusion bonding, forge welding, shape rolling, roll forging, sheet or strip rolling, or composite fabrication. The isothermal rolling of strip and sheet products is a special application of the general isothermal metal working concept. But, the molybdenum tools or rolls are not heated directly before making contact with the feedstock. To avoid roll chill, heat must flow from the electrically-heated portion of the work roll in contact with the feedstock to the adjacent portion of the work roll about to make contact with the feedstock. The time required for this heat flow limits the roll speed to about 1 to 2 inches per minute, although reductions in metal thickness exceeding 90 percent per pass can be accomplished with this method.

The isothermal metal working techniques disclosed in my earlier patents have been reduced to practice for several applications. Manufacturers now use diffusion bonding as discussed in U.S. Pat. No. 3,644,698 for manufacturing 12-foot-long T-sections of nickel-based Hastelloy X for gas turbine engine applications. Others use isothermal roll forging machines to form 0.010-inch by 2-inch titanium-based Ti6A14V alloy strips for gas turbine applications. The isothermal roll forging technique allows use of alloy compositions that were otherwise difficult to forge with the integrity necessary for gas turbine applications.

However, my earlier isothermal techniques are much more difficult to apply to the rolling of wide sheets because of the necessity of precise control of conditions within an inherently unstable deformation process occurring in a THZ over a large surface. Forming metals into wide sheets in a continuous process requires passing the feedstock through a THZ in a work region of controlled temperature and pressure such that the metal flows enough to attain a new shape, but not so much that the metal ruptures. Attempts by practitioners in the art to apply isothermal roll forging techniques to form wide sheets have proceeded over the past decade. None have succeeded in controlling THZ conditions with enough precision and uniformity to achieve useful products.

These investigators have identified several problems. Problems include difficulty with the control of the several hundred-thousand amperes of feedstock heating current necessary for wide THZ's, occasional cracking of the molybdenum alloy work roll sleeves, trapezoidal beam deformation of hollow work rolls, and slow feed rates imposed by inadequate THZ control. These problems contribute to an inability to form sheet thicknesses less than 0.050 inches in an isothermal roll forge. Until the present invention, no investigator has succeeded in solving these problems, which result in sheet product irregularity, buckling, and rupture. Consequently, continuous forming of titanium-aluminide alloy sheets wider than two inches having thicknesses less than 0.100 inches requires special methods such as pack-rolling and even then thicknesses below 0.050 inch present severe difficulties.

The key economical benefit to my original isothermal rolling methods is the single pass feature of the roll forging process. This is a substantial economical benefit enjoyed when applying the method to the manufacture of continuously rolled strip up to two inches in width and other forged components. The primary economical failure of the application of isothermal roll forging to wide sheets is the high electrical current requirement. Because the required isothermal heating current is a function of the path resistance and hence of the work roll-feedstock contact area, the typical 30,000 ampere heating current required for a two-inch roll width is increased to 180,000 amperes at 12-inches and 360,000 amperes at 24-inches of width.

Practitioners have attempted to reduce this current requirement by electrically isolating and heating a rim of the work roll surface, thereby increasing the path resistance and reducing the heating current requirement. This isolation was accomplished by introducing a "loose tire" work roll for a 12-inch mill. Investigators found that the loose tire roll did indeed reduce electrical current requirements for an isothermal rolling mill, but only by a small percentage.

However, the loose tire mill suffered from unstable THZ control because of rocking about the work roll-feedstock contact line and trapezoidal distortion of the hollow work roll tire. I later discovered that the trapezoidal distortion results from the thermal stress introduced at the heated working surface of the roll. The combination of these problems effectively prevents the precise THZ control necessary for the production of uniform thin sheet with 12-inch wide loose tire work rolls.

The necessary THZ control precision has been obtained in a two-inch isothermal rolling mill, which has produced uniform, continuous sheet using large (12 inch diameter) work rolls. This mill reduces feedstock thickness by 90 percent in a single pass, although the large reduction requires a compressive feed force applied to the feedstock to compensate for roll slippage. Also, roll chill problems and THZ control considerations require a second, independent electrical current to preheat the feedstock ahead of the work zone between the work rolls. This second electrical current requires separate, duplicate control means and circuitry. These requirements are all exacerbated by attempts to increase mill width for wider foils.

Isothermal roll forging was a distinct improvement over conventional cold and hot rolling processes and allowed the rolling of thin sheet with large rolls for the first time. This is understood by recognizing that, with isothermal roll forging, an electrical current heats the working roll through the contact resistance existent only at the line of contact with the feedstock. The thermal bulge introduced in the solid work roll by the localized heating is believed to compensate for the roll flattening normally induced by compressive stresses at the feedstock. Roll flattening is responsible for the classical assumption that thin sheet cannot be formed with large rolls.

But, when attempting to roll sheets wider than two inches, heating the roll in a local zone becomes a disadvantage because of roll chill problems arising from the thermal latency in the roll. Increasing the electrical current can overcome the thermal latency but the several hundred-thousand amperes required for significantly wider isothermal rolling mills makes the application economically infeasible. Attempts by practitioners to obtain satisfactory performance while reducing electrical current requirements by limiting current flow to the loose tire failed because trapezoidal distortion of the loose molybdenum tire resulted in increased sheet thickness at the edges, giving unsuitable results for rolled sheet.

The optimum speed of a two-inch isothermal rolling mill is about one inch per minute. This slow speed reduces the plastic flow stress in the feedstock and allows a 90 percent single-pass thickness reduction, which reduces the cost of isothermally rolled foil with respect to the cost of other conventional processes. The loose tire concept reduces the electrical current costs but allows only a 70 percent single-pass reduction, increasing the process costs accordingly. This approach also exacerbates roll sticking because of speed and flow instabilities in the THZ leading to rippling and roll slippage, and was unsuitable for rolling thin foils.

Because isothermal roll forming requires a compressive feed force, introduction of a loose tire results in roll position changes as a function of changes in compressive feed forces and exit tensile forces. The only advantage found by practitioners using a loose tire roll was the reduction in electrical current requirements and a fifty percent increase in processing speed made possible by a related reduction in thermal latency in the tire near the work region. This increase in speed was obtained at the expense of product uniformity and control precision. The minimum gauge produced by a 12-inch isothermal mill using a loose tire roll was 0.045 inches. This compares with the 0.010 inches produced by a two-inch isothermal mill using a 12-inch monolithic roll.

Roll forging means for producing thin sheets and foils from high-strength metals have been long sought in the art and are currently unknown except for the limited success of the isothermal roll forging techniques disclosed in my earlier patents. These isothermal techniques are well-suited for many applications but have limited usefulness for rolling thin sheets and foils. Attempts by practitioners in the art to apply these isothermal roll forging methods to the production of thin sheets wider than two inches have shown no signs of economic or technical feasibility. The hundreds of thousands of amperes of roll heating currents required for the wider mills using monolithic rolls are not economically feasible All methods proposed in the art for reducing this heating current expense had new and undesired effects on foil thickness, finish and uniformity.

The keenly felt need in the art for a useful technique to continuously form thin sheets or foils of difficult-to-work metals such as aluminides, intermetallics, oxide-dispersion-strengthened (ODS) composites, beryllium and others has not been met until now. The only techniques known in the art for forming these metals into useful components are of limited interest because of very high costs. The unresolved problems and deficiencies discussed above are clearly felt in the art and are solved by the present invention in the manner described below.

SUMMARY OF THE INVENTION

The present invention is an improved isothermal roll forging method and apparatus that overcomes the above problems and deficiencies by incorporating several novel improvements to the isothermal roll forming technique known in the art. I present several novel improvements for precisely controlling temperature and pressure within a "travelling hot zone" (THZ) in the feedstock to solve the instability problems inherent in wide isothermal rolling mills. A primary feature of the present invention is that it employs a hollow, heavy-wall work roll electrode design with internal heating that substantially reduces the roll-feedstock contact line heating current requirements over those in the prior art. This is done by adding separate control means for preheating each work roll to a uniform temperature close to the desired isothermal working temperature. Another important feature is the reduction of the work roll diameter coupled with the addition of one or more support or backup rolls for each work roll. Each backup roll is driven by precisely controlled drive means to ensure uniform and synchronous rotation of both work rolls.

These improvements have several important advantages. First, the working roll is already hot when it makes first contact with the feedstock, thus preventing roll chill at entry and the resulting increase in flow stress. The work roll preheating also removes the severe speed limitation of known isothermal rolling mills. Also, the roll-feedstock contact line current density is drastically reduced, thereby reducing sticking caused by hot spots. By using separate control means for work roll preheating, the contact line current flow can be used to preheat the feedstock, which is an important advantage of the present invention.

To maintain the high stiffness required for rolling thin sheet, each work roll is supported with at least one backup roll having a larger diameter for the necessary stiffness. The use of the recommended four-high or six-high roll configurations is a novel improvement that offers several unexpected advantages. One important advantage is that routing the roll-feedstock current through the backup rolls in the manner required by the mill geometry unexpectedly minimizes heat loss from the work rolls while also reducing the current required in a conventional isothermal rolling mill. Another significant advantage is that the need for high-stress commutator bearings for the work roll and all water-cooled commutator requirements are eliminated because the work rolls are heated by internal heating elements that remain stationary. Yet another advantage is that the axis of at least one backup roll is offset slightly from the work roll axis to provide a horizontal force component to offset the compressive feed force imposed by the feedstock. The force component available for opposition to the feed force prevents flexure of the work rolls and improves the uniformity of the resulting rolled foil or sheet. Another advantage is that the reduced roll chill and improved THZ flow deformation increase the operating roll speed and reduces drag, thereby improving the process efficiency.

Another important feature of the present invention is that the control means for the internal work roll heater current are separate from the control means for the currents flowing through the work rolls and feedstock. This permits separate control of the feedstock preheating current, which is the sum of the heating currents flowing through the two work rolls at the feedstock contact lines. The stationary internal work roll heaters operate independently of these heating currents so that the preheat temperatures of the work roll and feedstock can be independently controlled. A heating current flows through each work roll and the feedstock at the THZ, thereby raising the temperatures of feedstock and work roll to the desired THZ working temperature by virtue of the contact resistance existing at the contact line.

Note that the present invention employs two independently-controlled heating sources to improve control of the temperature in the THZ and at least one backup roll for each work roll to improve control of pressure in the THZ. It is a key feature of the present invention that the temperature and pressure within the THZ are controlled to close tolerances. This precise control is essential for the isothermal rolling of sheets of alloys of low ductility because the available forming temperature ranges of these materials are very narrow and exist only within a specific forming pressure region. This narrow temperature and pressure forming region is the reason such materials cannot feasibly or economically be formed using conventional roll forging techniques where surface chill by the rolls is a severe problem. The control precision of the present invention allows the conditions within the THZ to be made uniform throughout, thereby avoiding flaws in the rolled metal product that will result from small variations in THZ conditions.

Addition of precise and accurate control means for driving the backup roll is an important feature of the present invention. The necessary precision cannot be provided using the conventional belt drive means used in existing isothermal rolling mills and known in the art. The backup roll drive means must be implemented using precision chain drive techniques known in the art that will not stretch, which will minimize roll synchronization error.

It will be appreciated that the present invention for the first time makes all the advantages of the existing isothermal roll forming methods available to the production of sheet by adding novel and useful methods for precise control of THZ temperature and pressure uniformity. These improvements make it possible to form high temperature metals with limited ductility into wide sheets of excellent uniformity at reasonable cost. The foregoing, together with other features and advantages of the present invention will become more apparent when referring to the following specifications, claims and accompanying drawings.

BRIEF DESCRIPTION OF THE DRAWINGS

For a more complete understanding of the present invention, reference is now made to the following detailed description of the embodiments illustrated in the accompanying drawings, wherein:

FIG. 4, comprising FIGS. 4A, 4B and 4C, where

DESCRIPTION OF THE PREFERRED EMBODIMENTS

Although I use specific dimensions throughout this specification to provide clarity and simplicity, I do not intend that my invention be limited to the specific dimensions disclosed. It should be understood that all such dimensions may be viewed as exemplary only, unless specifically noted to the contrary.

Figure 1A:
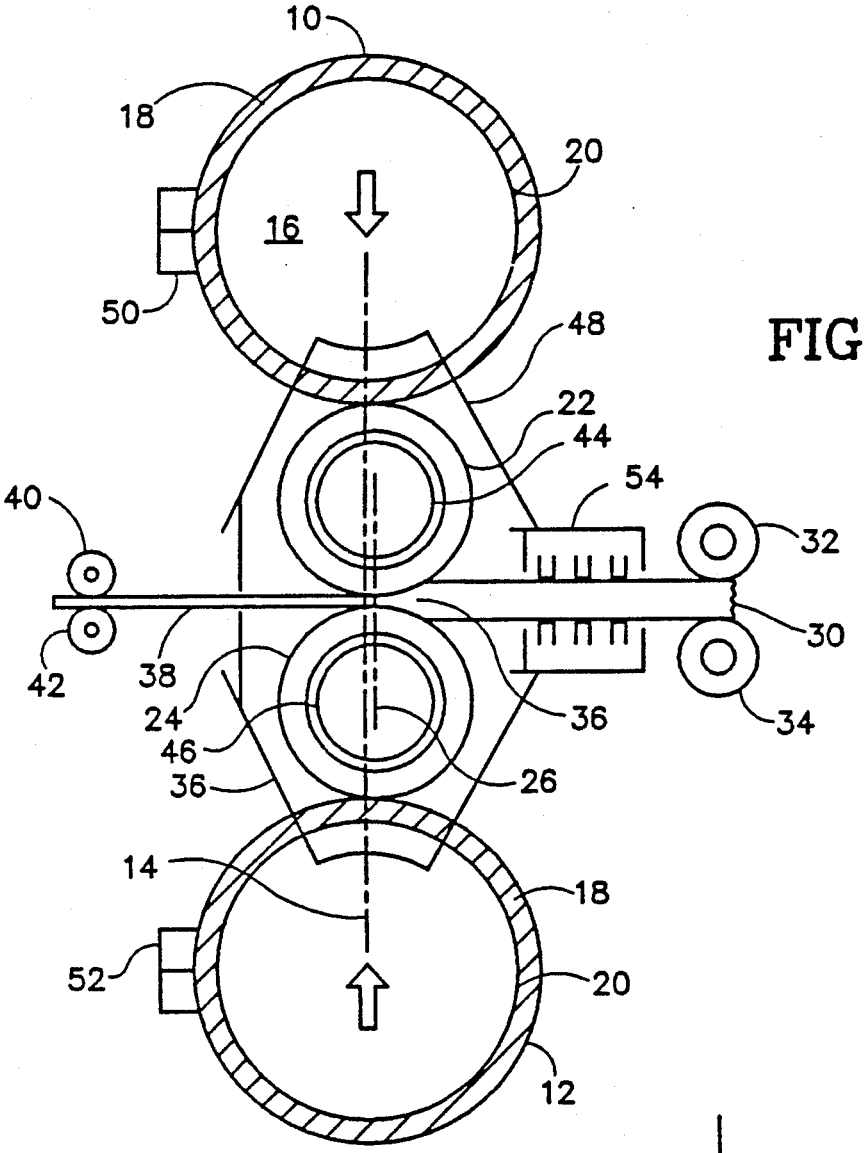
FIG. 1A illustrates the four-high rolling mill concept, showing a section through a schematic 24-inch wide mill and FIG. 1B schematically illustrates the backup roll offset feature.
Figure 7:
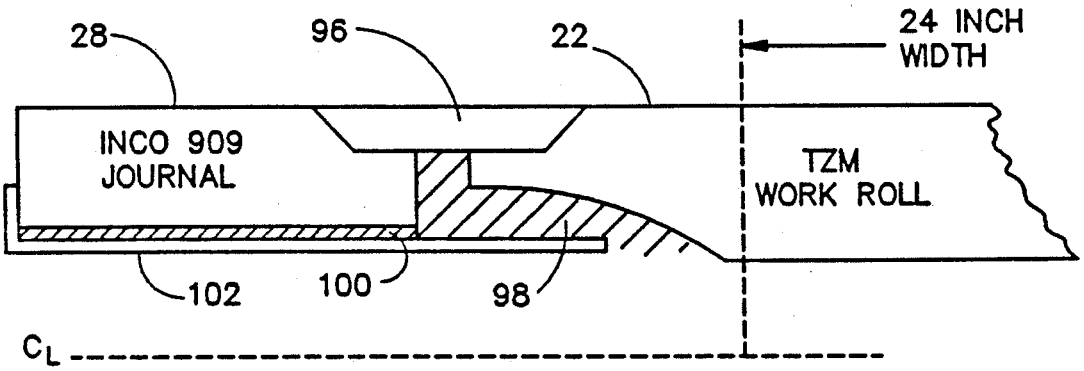
FIG. 7 illustrates a design of the internally heated work roll journal fabrication.

FIG. 1A illustrates the general concepts of the improved isothermal sheet rolling mill. Two solid backup rolls, 10 and 12 are positioned so that their axes define a vertical line 14. Backup rolls 10 and 12 are substantially 12 to 15 inches in diameter and are steel base rolls 16 each fitted with a molybdenum surface 18 over a thin layer of electrical insulation 20 to constrain the work roll heating current flow to the surface layer of the backup roll. Thick molybdenum facing 18 provides stiffness and strength at high temperature. Two hollow 8-inch diameter work rolls 22 and 24 are positioned with their axes forming a vertical line 26, which is parallel and offset slightly from vertical line 14. Work rolls 22 and 24 have 2-inch thick walls of a suitable molybdenum alloy. Work rolls 22 and 24 and backup rolls 10 and 12 are supported by journaled bearings at each end (not shown) that maintain their position, but allow vertical movement. FIG. 7 shows one illustrated embodiment of a work roll bearing journal 28 discussed in detail below. The feedstock 30 is supported by feed rolls 32 and 34, which grip feedstock 30 and impart a compressive feed force in the direction of work rolls 22 and 24. Feedstock 30 is forced through a travelling hot zone (THZ) in work region 36 where it is reduced to a thin sheet 38 supported by tensioning rolls 40 and 42. Tensioning rolls 40 and 42 grip and pull sheet 38 from work region 36. Feed force rolls 32 and 34 and tensioning rolls 40 and 42 are turned by independently controlled drive means (not shown).

The principal factors influencing selection of the 8-inch work roll diameter involve the desired quality of the sheet product. As is well-known in the rolling mill art, the Stone equation gives the minimum sheet thickness possible ($h_{min}$) from a rolling mill as:

$$h_{min}=3.58\ \mu DS/E$$

where:

$\mu$=roll/feed stock friction coefficient,

D=roll diameter,

S=Material flow stress in the work region, and

E=Young's modulus of roll material,

Stone's equation shows the need for a roll having high stiffness and small diameter in order to produce thin sheet. For end-supported rolls, stiffness and diameter move in opposite directions. Proper addition of backup rolls can provide sufficient support to reduce the absolute work roll stiffness requirement. The preferred embodiment of the present invention incorporates an 8-inch diameter work roll of TZM molybdenum alloy with a 2-inch wall thickness, which can be a composite roll with a shear spun surface. Because friction coefficient $\mu$ is reduced by graphite lubrication and flow stress S is low (e.g., 24,000 psi), the 8-inch molybdenum work roll ($E=30(10)^6$ psi at 1,800° F.) can produce sheet thicknesses down to 0.0023 inches.

An important feature of the present invention is the use of two independently controlled heating systems. The first of these uses stationary resistance heaters 44 and 46 inside work rolls 22 and 24, which provide the major source of work roll heating and prevent roll chill effects. The second heating system introduces matched electrical currents into backup rolls 10 and 12 through the brushes 50 and 52 to preheat work rolls 22 and 24 and feedstock 30. These matched electrical currents flow from backup rolls 10 and 12 through work rolls 22 and 24 and into feedstock 30, heating work region 36 to the desired working temperature and preheating feedstock 30 as the combined currents flow through feedstock 30 to brush assembly 54. Work rolls 22 and 24, feedstock 30, work region 36 and internal stationary resistance heaters 44 and 46 are enclosed in an argon atmosphere chamber 48 using techniques known in the art. Backup rolls 10 and 12 can have water-cooled shafts, although the presence of insulating layer 20 reduces heat loss to the bearings. The current through brush assembly 54 serves to preheat feedstock 30 ahead of work region 36. Flow stress S is minimized by preheating work rolls 22 and 24 with stationary internal work roll heaters 44 and 46 to a uniform temperature throughout, which prevents roll chill of work region 36. Roll chill of the feedstock will normally elevate flow stress S, increasing minimum sheet thickness in accordance with Stone's equation.

The effect of an 8-inch roll diameter can be further understood by comparing it to the effects of a 15-inch diameter work roll when rolling 0.25-inch plate of Ti-6A14V to 0.025-inch sheet in one pass. The preferred 8-inch roll has a reduced footprint length over the 15-inch roll (by 27%, from 1.3 to 0.95 inches). This reduces the necessary mill squeeze force by 27% but has no effect on the sheet thickness. The reduced footprint length requires that the THZ deformation be completed in 27% less time, however, and this higher strain rate increases the mill squeeze force required by 10%. The increase in flow stress S then raises the minimum possible sheet thickness by 10%, by Stone's equation. The reduced chill at entry resulting from the internal work roll heaters will reduce squeeze force requirements by 47% for every 100° F. increase in THZ temperature for Ti6A14V feedstock. This translates into a 47% reduction in minimum sheet thickness for every 100° F. increase in the THZ temperature by Stone's equation. The disadvantage of a hollow 8-inch work roll diameter is the reduced stiffness relative to a 12-inch roll diameter. Adding at least one solid 15-inch diameter backup roll behind each work roll provides the stiffness necessary for the precise control of temperature and pressure conditions in the THZ.

Figure 1B:
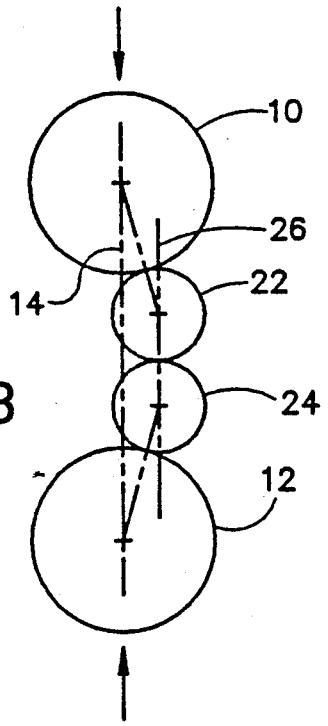
FIG. 1, comprising FIGS. 1A and 1B, where

FIG. 1B illustrates the effect of offsetting vertical lines 26 and 14 by distance s. The 114,000 lbs compressive feed force for a 24-inch wide mill shown in FIG. 1B will be counteracted by the horizontal component of a vertical compressive force of 1,200,000 lbs, provided that the axes of rolls 10 and 12 are offset from the axes of rolls 22 and 24 such that a 2.72° angle is defined by the axes of rolls 10 and 22 with respect to vertical line 14. For a 15-inch backup roll and an 8-inch work roll, distance s is 0.55 inches.

Figure 2:
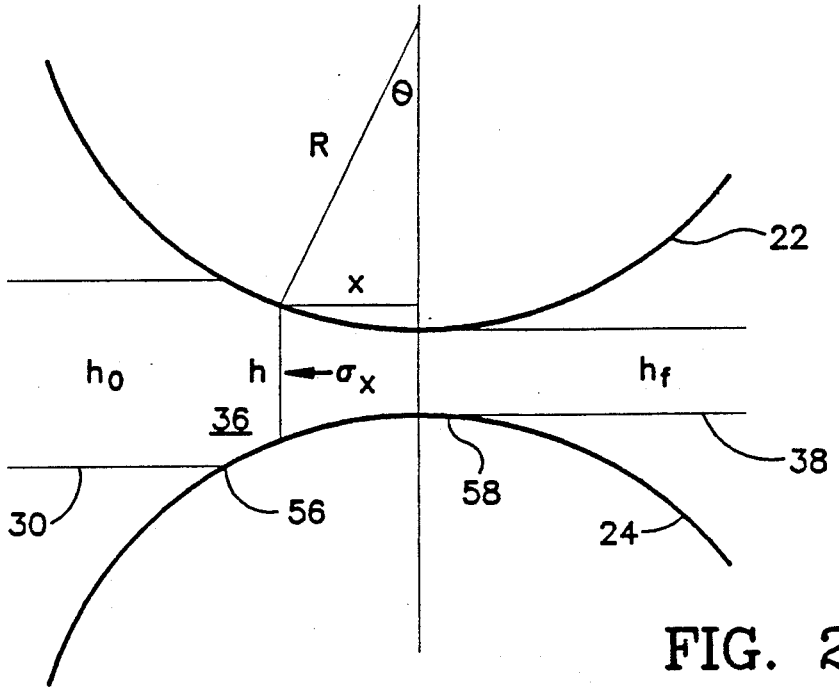
FIG. 2 schematically illustrates a section through the work region at the feedstock and work roll contact lines.

Thus, my present invention employs two independently-controlled heating sources to improve control of the temperature in work region 36 and at least one backup roll for each work roll to improve control of pressure in work region 36. The isothermal rolling forging process disclosed by U.S. Pat. No. 3,944,782 was found to follow the deformation mode known to exist for cold rolling illustrated in the vertical plane section shown in FIG. 2. In this deformation mode, the low friction at the roll-feedstock interface allows plane sections to remain planar and produces a high quality surface on the product. FIG. 2 illustrates schematically work region 36 in feedstock 30 between work rolls 22 and 24. Feedstock 30 makes contact with work rolls 22 and 24 at the entrance 56 to work region 36. Thin sheet 38 emerges from work region 36 at the axis 58 seen in FIG. 2.

Figure 3:
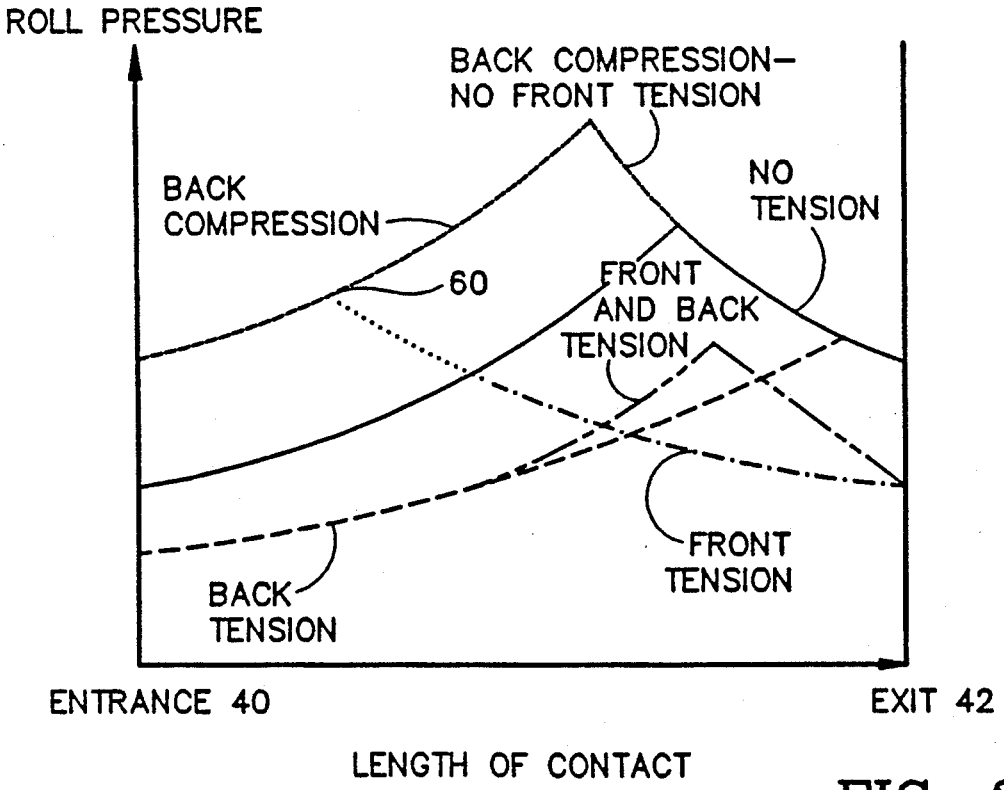
FIG. 3 illustrates the theoretical relationship between work region pressure distribution and front and back feedstock forces.

The THZ is formed within work region 36 around the peak pressure point 60 shown in FIG. 3, which moves about work region 36 in response to changes in front and back feedstock forces. FIG. 3 illustrates the roll pressure distribution in work region 36 as predicted theoretically using cold rolling theory. This illustrates the effects of the compressive feed force on feedstock 30 entering region 36 and the tensioning force on thin sheet 38 leaving region 36. Note that the roll pressure rises initially along work region 36, reaching a maximum at point 60. Maximum point 60 can be moved by changing front compression and back tension forces. Thus, these external feedstock forces act with the work roll compressive forces to control pressure conditions within the THZ.

Figure 5:
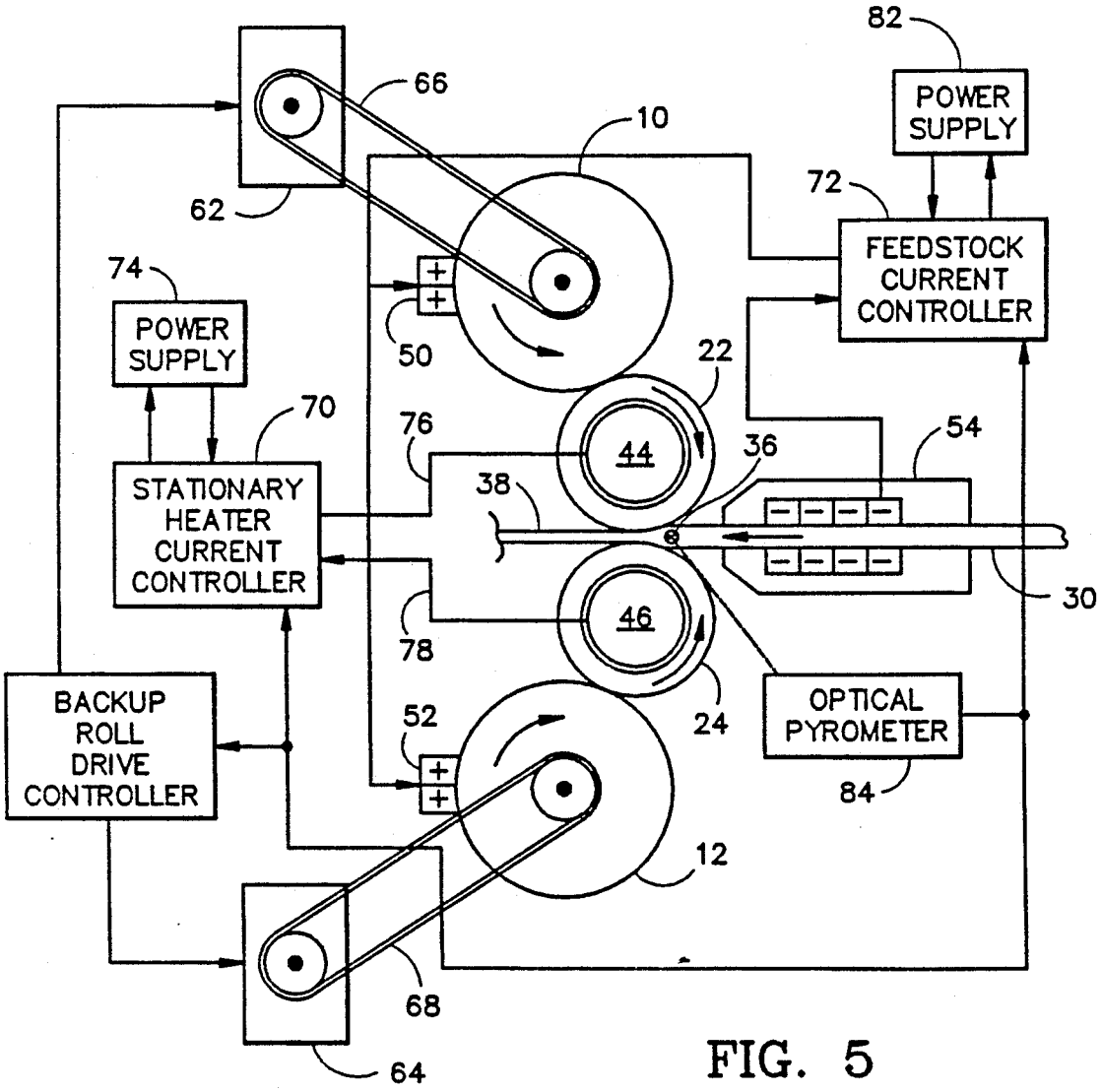
FIG. 5 illustrates the control means for the THZ heating current and the work roll heater current.

It is a key advantage of the present invention that the temperature and pressure within work region 36 are closely controlled to ensure optimum conditions in the THZ. This close control is essential for the isothermal rolling of sheets of low ductility alloys because the available forming temperature ranges of the materials of interest are very narrow. This condition of limited forming temperatures is the reason why such materials cannot feasibly or economically be formed using conventional roll forging techniques where surface chilling occurs. Precise and accurate control of the backup roll drive means 62 and 64 in FIG. 5 is also an important requirement of my present invention. The necessary precision cannot be provided using conventional belt drive means and must be implemented using the precision drive chains 66 and 68 or equivalent shown schematically in FIG. 5. Precise drive means 62 and 64 ensure that the rate of THZ movement along feedstock 30 is regulated with a precision comparable to the temperature and pressure regulation within work region 36.

Figure 4A:
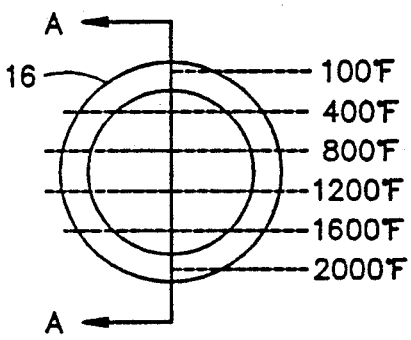
FIG. 4A shows a hollow work roll heated at the bottom.
Figure 4B:
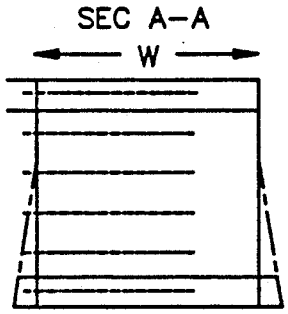
FIG. 4B shows a section A—A through FIG. 4A.
Figure 4C:
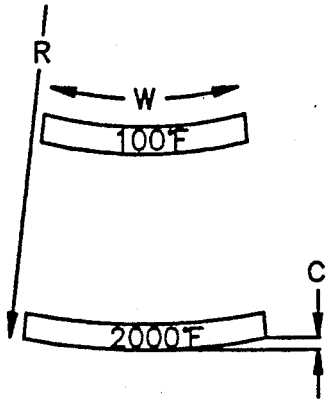
FIG. 4C illustrates the trapezoidal beam roll crowning effect in the nonuniformly heated hollow roll.

FIG. 4 illustrates the formation of trapezoidal beam roll with crown in a hollow work roll having a nonuniform temperature distribution. In FIG. 4, the top of roll 22 is at ambient temperature while the bottom of roll 22 is at the THZ working temperature induced by electrical currents flowing through the contact line at feedstock 30. At the 2,000° F.+THZ temperature, the bottom of roll 22 expands with respect to the top of roll 22, which is at ambient temperature. This expansion induces stresses within the roll cylinder. These stresses cause the deformation illustrated in FIG. 4C, where the working surface of roll 22 is crowned upward with a vertical displacement c at the lower edge. This lifted edge prevents the desired uniformity of temperature and pressure in the THZ and causes a thicker product at the edges. I have made these observations, which are not known in the prior art.

Figure 8:
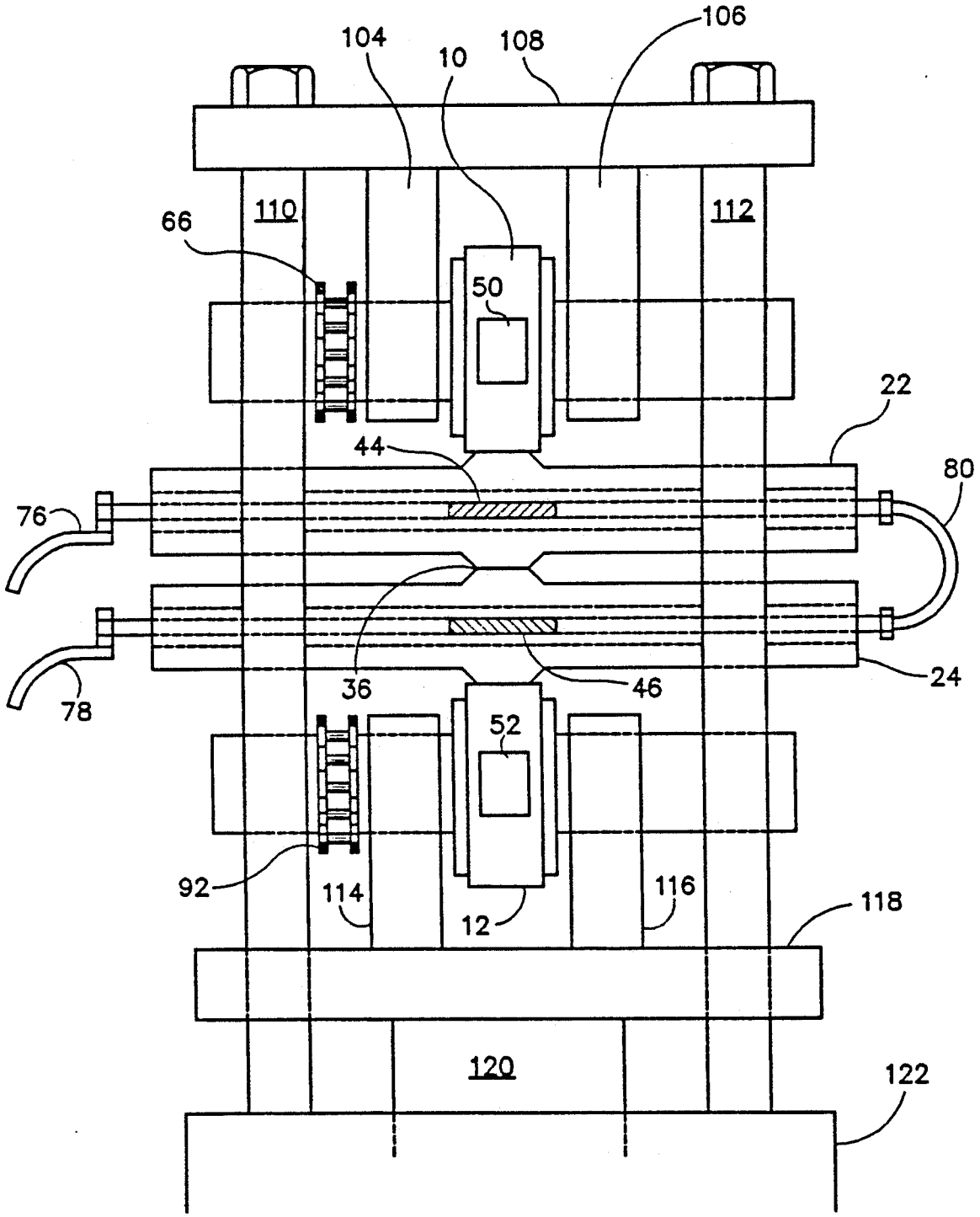
FIG. 8 provides a schematic design of a four-high embodiment of the present invention for strip based on a four-poster press.

Practitioners in the art have noted this problem in isothermal mill hollow work rolls but not the cause. Without knowing the cause of the roll crowning shown in FIG. 4C, practitioners have attempted to compensate by grinding roll 22 to a convex surface at room temperature. This solution has proved unsatisfactory. My explanation shows that this crowning will become more severe as the roll width increases so that the loose tire concept cannot be scaled up for wide mills. My present invention solves these problems for the first time by addressing the cause. The solution is to provide stationary internal heaters 44 and 46 within work rolls 22 and 24 to heat the entirety of each work roll to a selected temperature. The placement of heaters 44 and 46 is also shown in FIG. 8. The temperature is selected so that substantially no trapezoidal beam roll distortion occurs when work region 36 is heated by a small additional amount to the desired THZ temperature by the electrical current conducted through the roll-feedstock contact resistance.

FIG. 5 illustrates a THZ temperature control system showing two independent heating current control means 70 and 72. Work roll heater controller 70 regulates the flow of current from power supply 74 through internal heaters 44 and 46 by way of conductors 76 and 78. Heaters 44 and 46 are connected in series by a conductor 80 as shown in FIG. 8. Feedstock preheater current controller 72 controls the current from power supply 82 through backup roll brushes 50 and 52. The symmetrical currents through brushes 50 and 52 flow through backup rolls 10 and 12 and enter work rolls 22 and 24 at the point where they contact the backup rolls. An important feature of the present invention is the increased temperature at the contact lines between each work roll and the supporting backup roll. By passing electric current through this contact line, a high local temperature is generated by virtue of the contact resistance. This high local temperature prevents undesired work roll cooling at the contact line via conduction to the cooler backup roll.

From the heated backup roll contact line, the current flows through work rolls 22 and 24 and enters feedstock 30 at work region 36. From there, the current flows through feedstock 30 through brush assembly 54, thereby preheating feedstock 30, and then back to current controller 46. Optical pyrometer 84 is directed at work region 36 to determine work region temperature in a manner well-known in the art. The temperature measured by optical pyrometer 84 is transmitted to current controllers 70 and 72 for use in adjusting the heating currents as required to correct errors in work region temperature. The current from controller 72 passes through work rolls 22 and 24 and heats both work rolls 22 and 24 and feedstock 30 in work region 36 to the desired THZ temperature. This important feature of the present invention prevents temperature fluctuations within the THZ that might lead to a nonuniform product.

Figure 6:
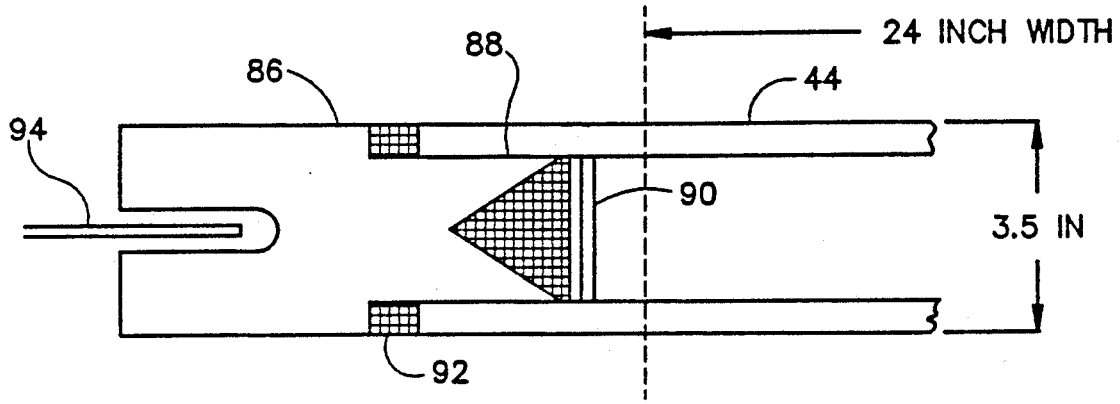
FIG. 6 illustrates the water-cooled insulated ends of the internal work roll heater.

FIG. 6 illustrates one detailed design of one end of stationary work roll heater 44 or 46 (see FIG. 8). This design uses a molybdenum resistance heater. Heater elements of graphite or silicon carbide are also suitable. The preferred embodiment requires an internal heater design that will replace the heat loss from the 8-inch diameter work roll. The loss of heat from an 8-inch diameter by 24-inch long work roll at 2,000° F. (1,366°K) radiating to absolute zero is given by:

$$E=\sigma AT^4=74,428 \text{ watts}$$

where:

$\sigma$32 Stephan-Boltzmann radiation constant,

T=temperature difference in °K, and

A=radiating area.

Two work rolls will dissipate 149 kW. If the average ambient temperature is 1,640° F. (1,166°K), the energy loss decreases to 34,842 watts per roll, or 69.7 kW for the pair of work rolls. A design figure of 200 kW for total electrical input is preferred, which allows for convective and conductive losses in addition to the radiation loss. This total heating energy includes the current to internal work roll heaters 44 and 46, the primary electrical work region 36 heating current and the secondary feedstock 30 preheating currents.

For an internal heater of 3.5-inch diameter and 24-inch length, the element temperature required to radiate 50 kW is 2,635° F. (1,719°K). A 24-inch long tubular molybdenum alloy element with 0.4-inch walls will require 3.8 Volts and 13,100 Amps to dissipate 50 kW. Reducing the heater element wall thickness to 0.32 inches increases the necessary voltage to 4.2 volts and decreases the necessary current to 11,885 Amps. FIG. 6 shows a water-cooled molybdenum plug 86 disposed in the end of tubular heater 44 having the full 3.5-inch heater diameter. Plug 86 reduces the temperature from 2,635° F. to ambient over a length of 6- to 9-inches. The 3.5-inch internal heater diameter leaves 0.25-inches clearance on each side to the inner surface of the work roll (not shown). Plug 86 is held to heater 44 by a brazed joint 88. Radiative heat transfer from element 44 is inhibited by heat shields 90 and insulation 92 disposed as illustrated in FIG. 6. The outside end of plug 86 is held to ambient temperature by water-cooling means 94. Because brazed joint 88 conducts the heating current to element 44 from plug 86, the area of joint 88 must be sufficient to avoid significant voltage drop across the interface. The embodiment illustrated in FIG. 6 shows joint 88 to be 2-inches in length. Suitable designs in graphite can be implemented by those familiar with this art.

Several engineering problems have been solved to permit the use of the TZM molybdenum alloy heavy-walled work roll for the preferred embodiment. A method for manufacturing TZM heavy-walled tubes with adequate work in the TZM is known in the art. Although TZM molybdenum is preferred, the equivalent MT104 molybdenum alloy may also be used for this application.

The heated work roll must be isolated from the bearings to keep bearing temperatures at reasonable levels. In FIG. 7, this isolation is shown using tubular connection 96, which is fully adequate to transmit the bearing load from journal 28 to work roll 22. Tubular connection 96 is made of 90Ta-10W alloy, is slightly less than 8-inches in diameter for maximum opposition to the bending moment and is limited to 0.125- to 0.1875-inches in thickness to minimize heat transfer from roll 22 to journal 28. Fiber insulation 98 and plasma-sprayed insulation 100 are disposed as illustrated in FIG. 7 to minimize thermal heat flow across the isolation region. An inner ring 102 is shown as 90TA-10W alloy brazed in place with Si-Fe-Cr alloy. This tubular connection can be designed to transmit torque loads by well-known techniques if separate drive of the work roll is desired.

The high temperature work roll bearing must operate unlubricated up to 1,100° F. for the design shown in FIG. 7. The excellent performance and apparent low friction between molybdenum work rolls and various work-pieces with dry graphite lubrication is known in the art and is preferred for this application. The Inco-909 nickel-based alloy retains good strength to 1,200° F. (130,000 psi at 1,000° F.), although it has poor oxidation resistance at this temperature. For this reason and to protect the graphite lubricant, the bearings must be within argon atmosphere chamber 48 as illustrated in FIG. 1A. Also, the bearing blocks should be fabricated from Inco-909 alloy with bearing surfaces of high-density plasma-sprayed molybdenum. The bearings should have a surface area greater than six square inches to reduce bearing pressures to below 5,000 psi. Lubrication passages to maintain the graphite lubricant are included in each bearing block (not shown).

Other bearings known in the art for dry operation at this temperature are suitable for this application. Evidence that lubricants such as $MoS_2$ work well in air but not in vacuum is related to the formation of $MoO_3$. Other practitioners in the art have shown that CdO improves tribological performance of graphite at 1,000° F. In some cases, the work roll may be directly driven rather than indirectly through the support rolls. Attachment of a suitable drive to journal 28 may be achieved by means well-known to those experienced in the art. In practice, journal 28 must be cooled to a temperature somewhat lower than 1,100° F. to permit attachment of a suitable direct drive means.

FIG. 8 illustrates the four-high isothermal rolling mill embodiment based on a four-poster press to be used for rolling strip. The view is shown from the entry position. The force feed means, tensioning means, atmosphere chamber, hearer details and roll drive and bearing details are omitted. Work rolls 22 and 24 are shown in contact at work region 36. Work roll 22 is heated with internal heater 44 by means of an electric current through conductor 76 and work roll 24 is heated by internal heater 46, which receives current from conductor 78. Heaters 44 and 46 are connected by a flexible electrical coupling 80 connected in series. The width of the surfaces of rolls 22 and 24 shown in contact at work region 36 is substantially less than 24-inches in this strip mill.

Backup roll 10 is supported by bearing assemblies 104 and 106 from upper platform 108. Upper platform 108 is supported by four-posts, including the two posts 110 and 112 shown. Backup roll 10 is turned by a high-torque slow-speed chain drive 66. An important feature of the present invention is the use of a positively-engaged backup roll drive means such as drive 66 illustrated in FIG. 8. Backup roll 10 acts to support work roll 22 during operation.

Lower backup roll 12 is supported by bearing assemblies 114 and 116, which rests on lower platform 118. Backup roll 12 is driven by a high-torque slow-speed chain drive 68, which is similar to and driven in synchronization with chain drive assembly 66. Lower platform 118 is supported by hydraulic ram 120 and the entire four-poster press rests on base 122.

In operation, the isothermal strip rolling mill illustrated in FIG. 8 precisely controls the velocity, temperature and pressure of the THZ in work region 36. This affords precise control of the movement of the THZ along feedstock 30 (not shown) and, thereby, of the feedstock deformation within the THZ. Toward this end, hydraulic ram 120 lifts lower platform 118 and backup roll 10 upward to apply pressure against work roll 24. Work roll 24 applies pressure to work region 36 between work rolls 24 and 22. Chain drive assemblies 66 and 68 turn backup rolls 10 and 12 in close synchronization. Backup roll 10 turns work roll 22 by means of frictional coupling and backup roll 12 turns work roll 24 also by means of frictional coupling. Thus, it will be understood that the pressure in work region 36 is controlled indirectly by a control means (not shown) operating on hydraulic ram 120 and by control means 62 and 64 operating chain drive assemblies 66 and 68 as illustrated schematically in FIG. 5.

In FIG. 8, the temperature in the THZ at work region 36 is controlled by two means. First, work rolls 22 and 24 are heated to near the desired rolling temperature by internal heaters 44 and 46, which in turn are heated by current flowing through conductors 106 and 108 and flexible electric coupling 80. Secondly, a current is introduced through brush 50 into molybdenum surface 18 of support roll 10, which passes down through work roll 22 into work region 36 and exits through feedstock 30 at brushes 54 as shown in FIG. 1A and FIG. 5. A symmetrical control current enters molybdenum surface layer 18 of lower support roll 12 through brushes 52 and passes through work roll 24, exiting at work region 36 and proceeding through feedstock 30 to brushes 54 in similar fashion. These combined currents pass through feedstock 30, providing heat energy EIT/J, where E is the voltage drop from brushes 54 to work region 36, I is the current flow, T is the feedstock transit time and J is the mechanical equivalent of heat. Optical pyrometer 84 in FIG. 5 is sighted at work region 36 and provides a feedback signal to current controllers 70 and 72 to hold the feedstock metal temperature precisely at the required value through modulation of the heating currents.

Figure 9:
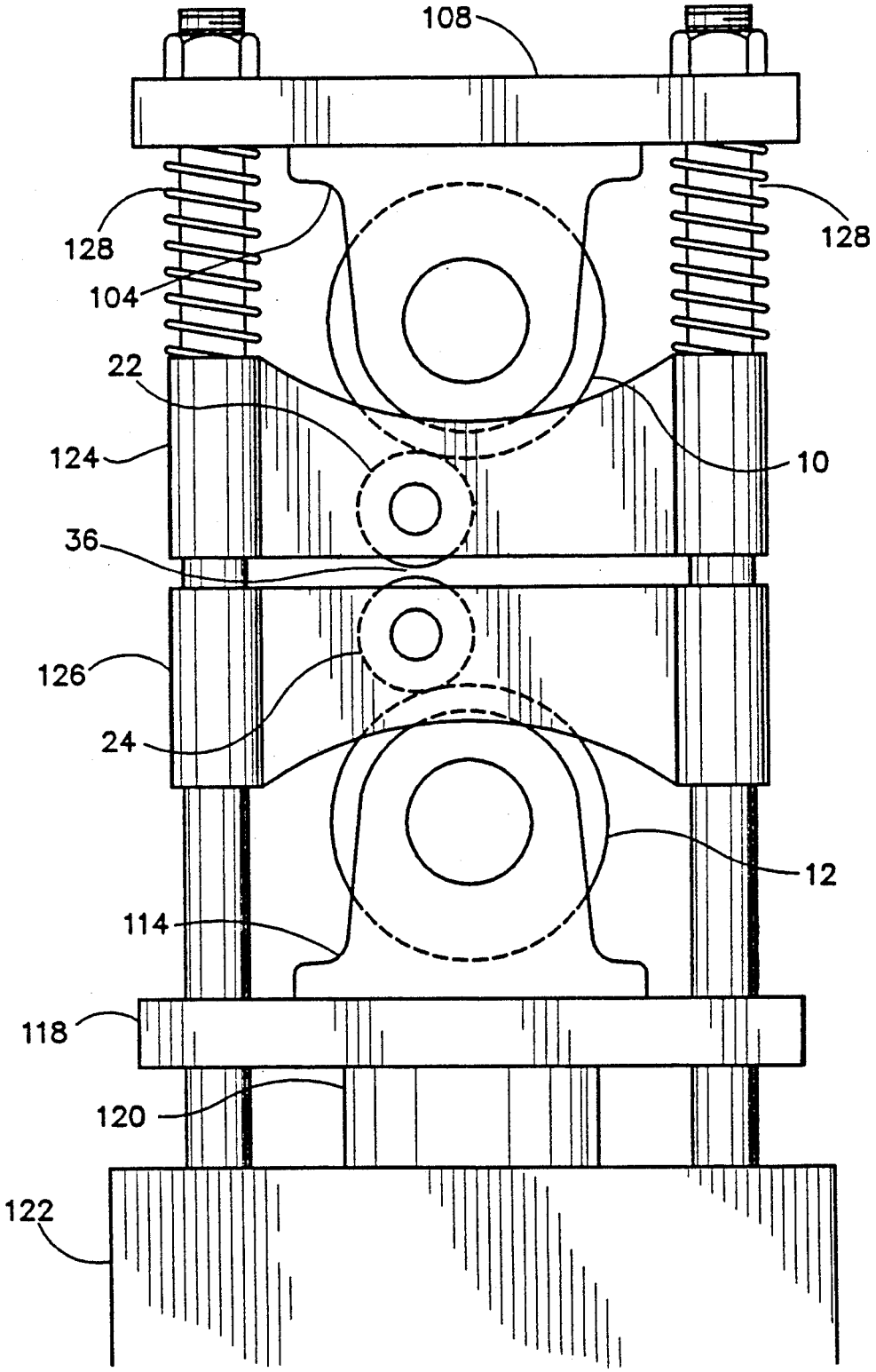
FIG. 9 shows a side view of the embodiment in FIG. 8.

FIG. 9 shows a section through the four-poster press illustrated in FIG. 8. In FIG. 9, work roll 22 is shown supported by work support assembly 124 and work roll 24 is shown supported by work roll support assembly 126. Tension retainer spring means 128 are shown on posts 80 and 82. All four posts are equipped with tension retainer spring means 128, which acts to retain work roll support assembly 124 in an elevated position when hydraulic ram 120 moves the lower assembly down and away from work region 36. Note also in FIG. 9 that work rolls 22 and 24 are offset from backup rolls 10 and 12 in the manner discussed in connection with FIG. 1B. This offset acts to counteract the feed force coming from the opposite direction.

Figure 10:
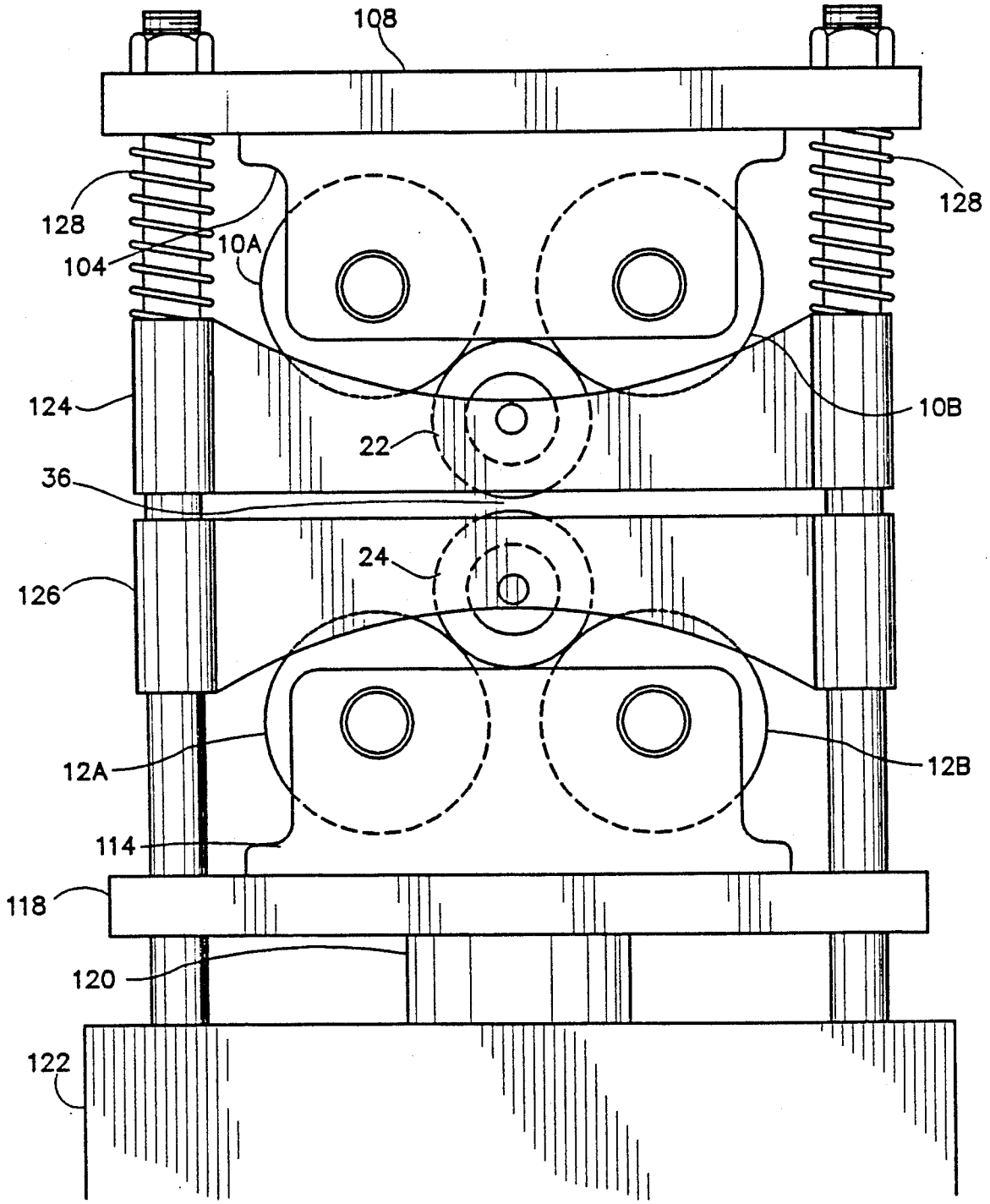
FIG. 10 provides a schematic design of a six-high embodiment of the present invention based on a four-poster press.

FIG. 10 illustrates an alternative embodiment of the isothermal sheet rolling mill shown in FIGS. 8 and 9. In FIG. 10 two backup rolls 10*a* and 10*b* are shown supporting work roll 22 and two backup rolls 12*a* and 12*b* are shown exerting pressure on lower work roll 24. The advantages of using two backup rolls in lieu of a single backup roll include increased frictional coupling, improved work roll stability in the face of compressive feed forces and improved work region dimensional stability. Using two backup rolls will improve sheet uniformity and thinness for materials having narrower plastic flow working temperature ranges.

The details of isothermal sheet rolling mill fabrication other than those discussed above in connection with the drawings are known in the art and can be appreciated by reviewing my earlier isothermal roll forming patents identified and discussed above. The dimensions and specifications used throughout this patent are provided for illustrative and instructive purposes only and I do not intend to limit my invention by any of these specified values unless I have explicitly stated otherwise. Obviously, other embodiments and modifications of the present invention will occur readily to those of ordinary skill in the art in view of these new teachings. Therefore, this invention is to be limited only by the following claims, which include all such obvious embodiments and modifications when viewed in conjunction with the above specification and accompanying drawings.

I claim:

1. Apparatus for the solid-state forming of a metallic feedstock into a component of selected configuration, comprising:

a first rotatable electrode means for supporting said feedstock;

a second rotatable electrode means for applying pressure to said feedstock;

biasing means for forcing said second electrode means against said first electrode means to exert a pressure of selected magnitude on said feedstock comprising at least one first rotatable backup means for supporting said first electrode means and at least one second rotatable backup means for applying force to said second electrode means;

first heating means for heating said first and second electrode means to a first selected temperature;

means for supporting said second backup means and second electrode means for movement toward and away from said first electrode means;

second heating means for heating said feedstock and that part of said first and second electrode means contiguous to a feedstock work region between said first and second electrode means to a second selected temperature comprising means for applying an electric current through said first and second electrodes and said feedstock;

control means for regulating the density of said current through said feedstock and the magnitude of said pressure exerted on said feedstock by said second electrode means so as to hold the feedstock temperature below its melting point but sufficiently high to produce in said work region a localized plastic flow zone in which said feedstock is in a plastic and flowable condition; and feeding means for moving said feedstock through said work region so as to cause said localized plastic zone to proceed uniformly along said feedstock.

2. The apparatus of claim 1 wherein said feeding means comprises speed regulation means that include:

force feed means for compressively forcing said feedstock into said plastic flow zone; and tensioning means for drawing said formed component from said plastic flow zone.

3. The apparatus of claim 2 wherein said force feed means comprises feed rolls drivingly engageable with said feedstock on opposite sides thereof.

4. The apparatus of claim 3 wherein said second heating means comprises slidably engaged brush connection means for diverting a selected portion of said electric current from said work region through said feedstock.

5. The apparatus of claim 2 wherein said first and second electrode means each comprises a thick-walled hollow roll having an axis.

6. The apparatus of claim 5 wherein said first heating means comprises:

a stationary electrical heating element disposed inside each said hollow roll; and means for applying electrical current to each said heating element.

7. The apparatus of claim 6 wherein said at least one first and second rotatable backup means each comprises at least one backup roll having an axis.

8. The apparatus of claim 7 wherein each backup roll axis is offset from the adjacent hollow roll axis such that a pressure applied to said second hollow roll by said second backup roll induces a force component in the direction of, but opposite to, the compressive feed force imposed on said second hollow roll by said force feed means.

9. The apparatus of claim 8 wherein said speed regulation means further comprises drive means positively engageable with both said at least one backup rolls for turning said backup rolls at a selected rate.

10. The apparatus of claim 7 wherein both said hollow rolls and backup rolls are free-wheeling.

11. The apparatus of claim 7 further comprising atmosphere enclosure means for entrapping and holding a chemically inert gaseous atmosphere around all heated components and said feedstock.

12. A method for minimizing heat loss from the work rolls of an isothermal rolling mill of the type employing at least, one backup roll to drive each work roll at a contact line comprising the step of:

passing a heating current through said contact line from said at least one backup roll to said work roll whereby the resultant heating at said contact line opposes thermal conduction loss from said work roll to said at least one backup roll.

* * * * *